US006824032B2

(12) United States Patent
Kumatori

(10) Patent No.: US 6,824,032 B2
(45) Date of Patent: Nov. 30, 2004

(54) CONTROLLER OF RUNNING TENSION OF PAPER WEB FOR ROTARY PRESS

(75) Inventor: Yoshizumi Kumatori, Yokohama (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 115 days.

(21) Appl. No.: 10/191,951

(22) Filed: Jul. 9, 2002

(65) Prior Publication Data

US 2003/0034375 A1 Feb. 20, 2003

(30) Foreign Application Priority Data

Aug. 9, 2001 (JP) ..... 2001-241546

(51) Int. Cl.[7] ..... B65H 23/192

(52) U.S. Cl. ..... 226/36; 226/44; 226/118.3; 242/418.1

(58) Field of Search ..... 226/118.2, 44, 226/36, 4, 118.3; 242/418.1

(56) References Cited

U.S. PATENT DOCUMENTS 4,151,594 A * 4/1979 Stern ..... 242/421.1
4,997,120 A * 3/1991 Tanaka et al. ..... 226/44
5,602,747 A * 2/1997 Rajala ..... 226/44
5,791,541 A * 8/1998 Jitsuishi et al. ..... 226/40
5,996,492 A * 12/1999 Jurkewitz et al. ..... 226/44
6,334,564 B1 * 1/2002 Kishine et al. ..... 242/418.1
6,473,669 B2 * 10/2002 Rajala et al. ..... 700/122

FOREIGN PATENT DOCUMENTS

JP 3035301 2/2000
JP 2001-048386 2/2001

* cited by examiner

*Primary Examiner*—John M. Jillions
(74) *Attorney, Agent, or Firm*—McGlew and Tuttle, P.C.

(57) ABSTRACT

A controller for controlling the running tension of paper web for rotary press includes a paper feed unit (1) and a printing unit (2) provided with a printing cylinder (21) rotating according to an operation speed command. An in-feed roller (4) is provided in a running path of paper web (W) from a paper roll (11) of the paper feed unit (1) to the printing cylinder (21). A dancer roller device (5) detects a displacement amount of a dancer roller (51) relative to a reference position of the dancer roller (51) and absorbs variations of the running tension of the paper web (W) by the displacement. A tension control processing unit (S1) performs signal generation processing to optimize the peripheral speed of the in-feed roller (4) with respect to the peripheral speed of the printing cylinder (21) based on the displacement amount of the dancer roller (51) and the operation speed command.

3 Claims, 2 Drawing Sheets

CONTROLLER OF RUNNING TENSION OF PAPER WEB FOR ROTARY PRESS

BACKGROUND OF THE INVENTION

1. Field of the Invention

The present invention relates to a paper web running tension controller for adjusting the tension of a paper web fed from a paper feed unit to a printing unit in a rotary press by displacement of a dancer roller and a rotation control of an in-feed roller independently driven, and particularly to a controller of running tension of paper web for rotary press capable of rapidly and smoothly absorbing tension variations and stabilizing the tension.

2. Description of the Related Art

In the art of a running tension controller in a path in which the paper web that is drawn out from a paper feed unit of a rotary press is fed to a printing unit, a conventional system is disclosed in Japanese Patent No. 3035301.

The art described in Japanese Patent No. 3035301 includes an in-feed roller for feeding a paper web toward the printing unit from the paper feed unit, a dancer roller for absorbing looseness of the paper web fed into the printing unit, pressing means for pressing the dancer roller against the paper web, position detection means for detecting the position of the dancer roller, an independent drive motor which is separated from the other drive systems and drives the in-feed roller, and control means for controlling the independent drive motor, so that during a normal operation, a ratio of the speed of the in-feed roller to the running speed of the paper web is set based on the output of the position detection means in order that the position of the dancer roller is kept in a specified area, and based thereon the independent drive motor is controlled.

The dancer roller always reciprocates, and when the position of the dancer roller is deviated to a high tension side, that is, in the direction in which the path becomes shorter, from the specified area, the speed of the in-feed roller is increased a little. By the increase in the speed, the position of the dancer roller is returned into the specified area, and when the dancer roller moves to pass there and is deviated to a low tension side, that is, in the direction in which the path becomes longer, from the specified area, the speed of the in-feed roller is decreased a little. By the decrease in the speed, the position of the dancer roller is returned into the specified area, and the dancer roller repeats reciprocation so as to move until it is further deviated to the high tension side, while the in-feed roller alternatively increases and decreases the speed.

At the time of starting operation, during a specified period until the position of the dancer roller enters the specified area, the speed ratio is set at a specified speed ratio based on the stop position of the dancer roller before the operation is started and based upon this, the independent drive motor is controlled.

When the dancer roller, which starts to move based on the specified ratio for the specified period at the start of operation, moves into the specified area which is set within a range where it can move, the speed ratio is set at the ratio similarly set at the time of the normal operation so that the dancer roller is kept within the specified area, and the dancer roller always reciprocates within the specified area like a pendulum.

At the time of the normal operation, the control means sets the speed ratio of the in-feed roller that differs a little relative to the running speed of the paper web based on the output of the position detection means so that the position of the dancer roller is kept within the specified area while always reciprocating, and performs the control based on this speed ratio so that the independent drive motor alternatively repeals an increase and a decrease of the speed. During the specified period at the start of the operation, the speed ratio is set at a predetermined specified speed ratio, and the independent drive motor is controlled based on the specified speed ratio.

Consequently, after the specified period at the start of the operation elapses, when a disturbance that causes the tension of the paper web to reduce works in succession while, for example, the dancer roller is moving to the low tension side, the position of the dancer roller is temporarily displaced to the low tension side to a large extent from the specified area. In such a case, the speed ratio of the in-feed roller also remains to be the speed ratio at the time of the aforementioned normal operation, and the rotation of the in-feed roller is controlled to be slightly decelerated. When the displaced dancer roller takes time to slowly return to the specified area, if the similar tension variations subsequently occur, the dancer roller is displaced further to the low tension side to absorb the tension variations and tries to absorb the tension variations, and therefore the dancer roller is deviated to a large extent from the aforementioned specified area to eliminate looseness of, for example, the paper web, which not only makes it difficult for the dancer roller to return to the specified area, but also causes the case in which it cannot absorb the tension variations and results in a lack of stability of tension, whereby there arises the possibility that a misregistration of printing is caused especially in the case of multicolor printing and the printing quality is impaired.

SUMMARY OF THE INVENTION

An object of the present invention is to provide a controller of running tension of paper web for rotary press, which drives a printing cylinder and an in-feed roller having separate drive means according to a common operation speed command, makes a difference of peripheral speeds of the printing cylinder and the in-feed roller larger as a displacement amount from a reference position provided in a displacement range of a dancer roller is larger to make tension variations caused by disturbances be surely absorbed, is capable of making the displacement amount small by moving the dancer roller quickly to the reference position, smoothly and gradually decreasing the difference of the peripheral speed of the in-feed roller relative to that of the printing cylinder so that the peripheral speeds thereof become the same when the dancer roller reaches the reference position, whereby the dancer roller does not always reciprocate, quickly returns to the reference position from the position with a large displacement amount, always keeps absorption ability of the tension variations high, and by extension, stable tension is maintained, eliminates misregistration, and maintains and improves printing quality.

Another object of the present invention is to provide a tension control processing unit suitable for controlling rotation of the in-feed roller.

Still another object of the present invention is to provide a paper web running controller for a rotary press capable of obtaining a printing paper surface without misregistration by stabilizing tension by increasing the ratio of the difference of the peripheral speed of the in-feed roller relative to the printing cylinder more than the case in which the operation is at a high speed side exceeding the aforementioned predetermined operation speed when the operation of the rotary press is at a lower speed side within a range not higher than the predetermined operation speed previously specified, the dancer roller displaced due to the aforementioned disturbances is returned to the reference position more quickly from the displacement position so that ability to absorb tension variations is always able to be kept high as in the case of the aforementioned high speed side.

In a disclosed embodiment, a controller of running tension of paper web for rotary press is constituted to have an in-feed roller which is placed to form a running path of paper web drawn out of paper roll to reach the printing cylinder and is rotationally driven by independent drive means; a dancer roller device having the dancer roller, which is placed to form the running path of the paper web from an area after the in-feed roller to an area where the paper web reaches the printing cylinder and is provided to be displaceable to absorb variations of running tension of the paper web, and provided with displacement detection means for detecting a displacement amount of the dancer roller; and a tension control processing unit for controlling a rotational speed of the aforementioned in-feed roller by controlling an operation of the aforementioned independent drive means based on the displacement amount of the dancer roller detected in the displacement detection means and the operation speed command, so that a peripheral speed of the in-feed roller becomes the same as a peripheral speed of the printing cylinder when the dancer roller is at a reference position specified in a displacement range thereof, the peripheral speed of the in-feed roller becomes lower than the peripheral speed of the printing cylinder when the dancer roller is displaced to a position at which the running path of the paper web is made longer than at the reference position, and the peripheral speed of the in-feed roller becomes higher than the peripheral speed of the printing cylinder when the dancer roller is displaced to a position at which the running path of the paper web is made shorter than at the reference position, and by controlling the operation of the aforementioned independent drive means so that as the displacement amount of the dancer roller from the reference position becomes larger, the difference of the peripheral speeds of the printing cylinder and the in-feed roller becomes larger.

DETAILED DESCRIPTION OF THE PREFERRED EMBODIMENTS

An embodiment according to the present invention will be explained with reference to the drawings below.

Figure 1:
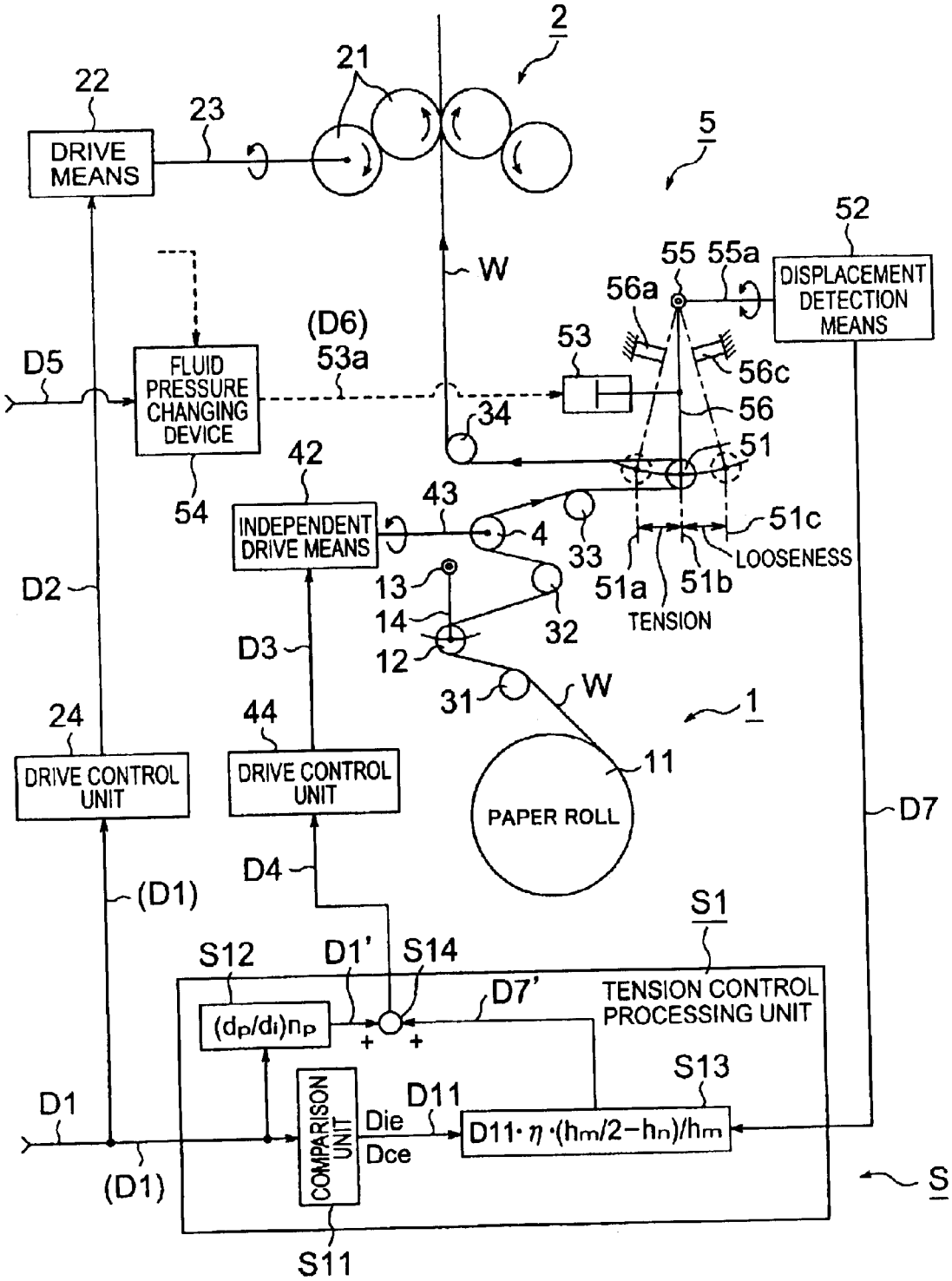
FIG. 1 is an explanatory diagram of a constitution of a paper web running tension controller being one embodiment according to the present invention.
Figure 2:
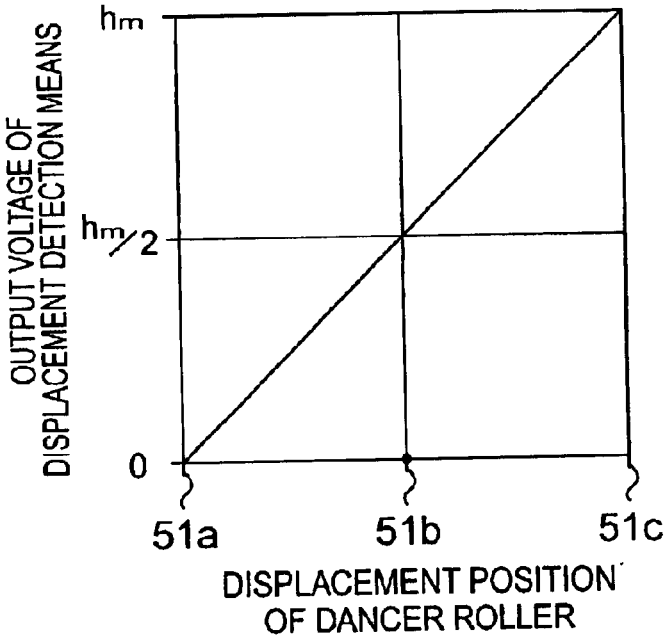
FIG. 2 is an explanatory diagram exemplifying a relationship of an output voltage of displacement detection means with respect to a displacement amount of a dancer roller.
Figure 3:
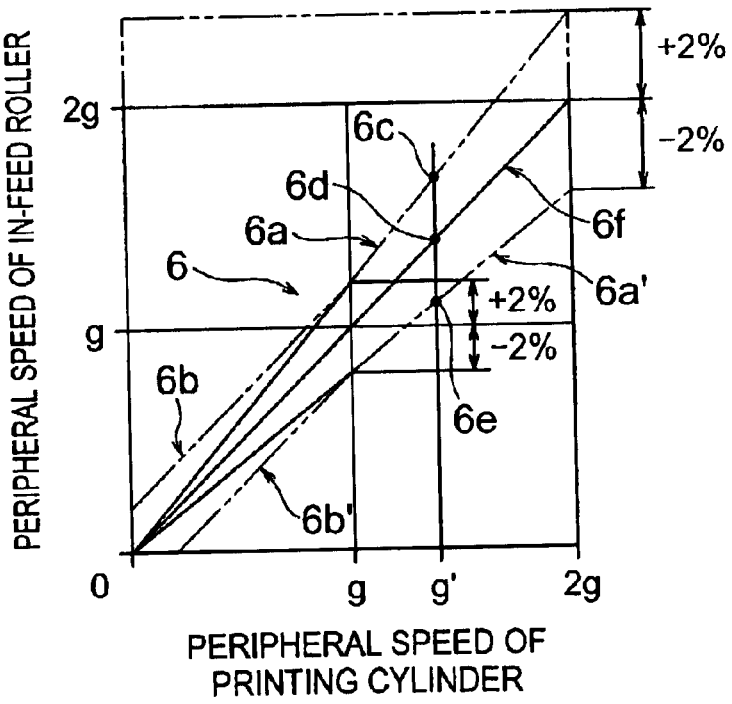
FIG. 3 shows the relationship of a peripheral speed of an in-feed roller with respect to a peripheral speed of a printing cylinder, and is an explanatory diagram exemplifying the peripheral speed of the printing cylinder and a maximum peripheral speed and a minimum peripheral speed of the in-feed roller with respect to the peripheral speed of the printing cylinder.

FIG. 1 is an explanatory diagram of a constitution of a paper web running tension controller, which is an embodiment according to the present invention, FIG. 2 is an explanatory diagram exemplifying relationship of output voltage of displacement detection means with respect to a displacement amount of a dancer roller, and FIG. 3 shows the relationship of a peripheral speed of an in-feed roller with respect to a peripheral speed of a printing cylinder, and is an explanatory diagram exemplifying a peripheral speed of the printing cylinder and a maximum peripheral speed and a minimum peripheral speed of the in-feed roller with respect to the peripheral speed of the printing cylinder.

As shown in FIG. 1, in a rotary press, a paper web running tension controller S is provided in a running path of paper web W drawn out of a paper feed unit 1 to a printing cylinder 21 between the paper feed unit 1 including a paper roll 11, which includes a braking device not shown and is rotatably supported by a support unit, and having a floating roller 12 at a downstream side thereof, and a printing unit 2 including the printing cylinder 21.

The running path of the paper web W is formed so that the paper web W is fed via, for example, the floating roller 12 existing between guide rollers 31 and 32 as shown in FIG. 1, an in-feed roller 4 between guide rollers 32 and 33, and a dancer roller 51 existing between guide rollers 33 and 34. The paper web W contacts an outer peripheral surface of the in-feed roller 4 rotationally driven by independent drive means 42 as described later, and is drawn out of the paper roll 11 by frictional force of both of them.

The floating roller 12 of the paper feed unit 1 is rotatably supported at one end of an arm 14 supported at a frame not shown to be angularly displaceable by an arm end 13. A fluid pressure cylinder not shown is connected to the arm 14 to absorb tension variations of the paper web W, which is wound around the floating roller 12, in the paper feed unit 1.

Drive means 22 being a motor driving the printing unit 2 is independently provided, and its output shaft 23 is connected to the printing cylinder 21. An operation speed command D1 for instructing an operation speed of the printing cylinder 21, which is outputted from a control unit not shown of the rotary press, is processed in a drive control unit 24, and the motor of the drive means 22 is rotated according to a rotation signal D2 outputted from the drive control unit 24, whereby the printing cylinder 21 is driven.

Meanwhile, independent drive means 42 being a motor for driving the in-feed roller 4 is individually provided, and its output shaft 43 is connected to the in-feed roller 4. The in-feed roller 4 is rotationally driven by the independent drive means 42 based on a signal generated based on the aforementioned operation speed command D1 and a displacement signal D7 which is a result of detecting a displacement amount of the dancer roller 51 by the displacement detection means 52, as will be explained later. The aforementioned displacement detection means 52 is, for example, a potentiometer, and the aforementioned displacement signal D7 is an output voltage from the potentiometer.

The dancer roller device 5 includes a dancer roller 51 which can be displaced so as to increase and decrease the length of the running path of the paper web W between the in-feed roller 4 and the printing cylinder 21 of the printing unit 2, a fluid pressure cylinder 53 being an air pressure cylinder which can displace the dancer roller 51 so as to increase the running path of the paper web W against the running tension of the paper web W and which can increase and decrease air pressure it supplies to thereby make it possible to increase and decrease the running tension, a pressure fluid supply pipeline 53*a* for supplying pressure fluid as pressurizing air to the fluid pressure cylinder 53, a fluid pressure changing device 54 for changing pressure of the aforementioned pressure fluid, and the aforementioned displacement detection means 52 for detecting the displacement direction and position of the dancer roller 51. The aforementioned fluid pressure changing device 54 is, for example, an electric-pneumatic converter.

A fluid pressure setting signal D5 from the control unit of the rotary press is set and inputted into the fluid pressure changing device 54. The fluid pressure changing device 54 adjusts pressure fluid supplied from a pressure fluid source not shown based on the fluid pressure setting signal D5, and inputs fluid D6 at pressure corresponding to the fluid pressure setting signal D5 into the fluid pressure cylinder 53. Thereby, a cylinder rod of the fluid pressure cylinder 53 operates to protrude, and the dancer roller 51 operates to remove looseness of the paper web W and the tension of the paper web W keeps the tension set in the fluid pressure changing device 54.

The dancer roller 51 is rotatably supported at one end of an arm 56 that is angularly displaceable and an arm end 55 being the other end of the arm 56 is attached to a support shaft 55*a* supported at a frame not shown to be angularly displaceable. A rod tip end portion of the aforementioned fluid pressure cylinder 53 is connected to a middle portion of the arm 56.

A force caused by the fluid pressure cylinder 53 to which the pressure fluid is supplied and tension of the paper web W looped around the dancer roller 51 keep balance via the arm 56 while absorbing tension variations of the paper web W looped around the dancer roller 51 by angular displacement of the arm 56, whereby the tension of the paper web W is kept substantially constant.

Further, a pair of stoppers 56*a* and 56*c* for restricting a displacement range of the dancer roller 51 supported by the arm 56 are provided to be in contact with the arm 56 which is angularly displaced. The stoppers 56*a* and 56*c* control the displacement of the dancer roller 51 that is larger than necessary to a tension side position 51*a* for decreasing the running path of the paper web W or to a looseness side position 51*c* for increasing the running path of the paper web W.

The displacement detection means 52 for detecting the displacement direction and displacement position of the dancer roller 51 is connected to the support shaft 55*a* to which the arm end 55 is attached so as to be operated by the angular displacement of the arm 56, so that an outputted displacement signal D7 is inputted into a tension control processing unit S1.

The tension control processing unit S1 includes a comparison unit S11, a first computation unit S12, a second computation unit S13, and compensation unit S14, and the operation speed command D1 outputted from the control unit of the rotary press and the displacement signal D7 being a voltage signal outputted from the aforementioned displacement detection means 52 are inputted therein. In the tension control processing unit S1, compensation processing of the aforementioned operation speed command D1 is performed based on the displacement signal D7 as will be explained later in order that the in-feed roller 4 is rotated with a difference in the appropriate peripheral speed being given as necessary with respect to the peripheral speed of the printing cylinder 21, and the speed signal D4 is generated to be outputted to the drive control unit 44. In the drive control unit 44, the rotation signal D3 for rotating the independent drive means 42 for driving the in-feed roller 4 based on the speed signal D4 is outputted.

The rotation of the motor of the independent drive means 42 for driving the in-feed roller 4 is controlled according to the rotation signal D3 outputted from the drive control unit 44. For example, if an inverter is used as the drive control unit 44, a three-phase inductive motor is used for the independent drive means 42, and if appropriate converted frequency is set as the rotation signal D3 and supplied to the independent drive means 42, the rotational speed of the three-phase inductive motor of the independent drive means 42 can be easily controlled.

The rotation control is performed for the in-feed roller 4 at an increased peripheral speed with respect to the aforementioned reference peripheral speed of the in-feed-roller 4 which is a peripheral speed equal to the peripheral speed of the printing cylinder 21 (hereinafter, called "printing cylinder peripheral speed") rotated based on the operation speed command D1 when the dancer roller 51 is displaced in the direction of the tension side position 51*a* from a reference position 51*b*, and when the dancer roller 51 is displaced in the direction of the looseness side position 51*c* from the reference position 51*b*, the rotation control is performed for the in-feed roller 4 at a decreased peripheral speed with respect to the reference peripheral speed of the in-feed roller 4. When the dancer roller 51 is located at the reference position 51*b*, the rotation control is performed for the in-feed roller 4 at the aforementioned reference peripheral speed equal to the peripheral speed of the printing cylinder 21.

An operation in one embodiment according to the present invention structured as above will be explained next with reference to the drawings.

The dancer roller 51 is normally given a force to displace in the direction of the looseness side position 51*c* by the operation of the fluid pressure cylinder 53 connected to the angularly displaced arm 56 to give the appropriate tension to the paper web W, as shown in FIG. 1. The dancer roller 51 displaceable by being supported by the arm 56 is displaced in the range controlled by a pair of the stoppers 56*a* and 56*c*, and the displacement signal D7 is outputted by the displacement detection means 52 connected to the support shaft 55*a*.

The displacement signal D7 is a voltage signal proportional to the displacement amount of the dancer roller 51, which is from the displacement detection means 52 for detecting the displacement of the dancer roller 51, and this is set so that for example, as shown in FIG. 2, the output voltage is 0 at the tension side position 51*a* where the dancer roller 51 contacts the stopper 56*a*, the output voltage is one-half of $h_m$ at the reference position 51*b*, and the output voltage is $h_m$ at the looseness side position 51*c*.

Specifically, when the dancer roller 51 is displaced in the direction of the tension side position 51*a* from the reference position 51*b* to absorb the tension variations caused by disturbances such as tension, looseness and elongation of the paper web W in the running path of the paper web W, the voltage according to the displacement amount of the dancer roller 51 in the range of the aforementioned output voltage from one half of $h_m$ to 0 is outputted as the displacement signal D7 from the displacement detection means 52.

When the dancer roller 51 is displaced in the direction of the looseness side position 51*c* from the reference position 51*b*, the voltage according to the displacement amount of the dancer roller 51 in the range of the output voltage from one half of $h_m$ to $h_m$ is outputted as the displacement signal D7 from the displacement detection means 52.

The displacement signal D7 which is outputted from the displacement detection means 52 according to the displacement amount of the dancer roller 51 is inputted in the tension control processing unit S1 as described above. As described above, the operation speed command D1 being a signal to instruct the operation speed of the printing cylinder 21 is inputted into the tension control processing unit S1 from the control unit of the rotary press.

In the tension control processing unit S1, the operation speed command D1 is inputted into the comparison unit S11 and the first computation unit S12 of the tension control processing unit S1, and in the first computation unit S12, the rotational frequency of the in-feed roller 4 is computed and compensated based on the difference of a diameter $d_i$ of the in-feed roller 4 and a diameter $d_p$ of the printing cylinder 21 so that the peripheral speed of the in-feed roller 4 rotated according to the operation speed command D1 conforms to the peripheral speed of the printing cylinder 21 rotated according to the operation speed command D1. A compensated speed command D1' compensated in the first computation unit S12 is inputted into the compensation unit S14.

Meanwhile, as for the operation speed command D1 inputted into the comparison unit S11, it is determined whether the command speed exceeds a predetermined speed g previously specified or not, and when the operation speed command D1 exceeds the predetermined speed g instructed by the operation speed command D1, a voltage signal D1*e* corresponding to the instructed speed is outputted to the second computation unit S13, and when it is not higher than the predetermined speed g, a voltage signal Dce corresponding to the predetermined speed g is outputted to the second computation unit S13.

In the second computation unit S13, D11 being the voltage signal D1*e* or Dce is inputted from the comparison unit S11 and the displacement signal D7 outputted from the displacement detection means 52 according to the displacement amount of the dancer roller 51 is inputted. The second computation unit S13 computes the peripheral speed difference of the peripheral speed of the in-feed roller 4 from the peripheral speed of the printing cylinder 21 corresponding to the displacement position of the dancer roller 51, and outputs a peripheral speed compensation signal D7'.

The peripheral speed compensation signal D7' is inputted into the compensation unit S14 where the aforementioned compensation speed command D1' is inputted. The compensation unit S14 adds the compensation speed command D1' and the peripheral speed compensation signal D7', and outputs the speed signal D4 being a voltage signal.

The compensation of the rotational frequency of the in-feed roller 4 based on the difference of the diameter $d_i$ of the in-feed roller 4 and the diameter $d_p$ of the printing cylinder 21 by the first computation unit S12 may be made by mechanical compensation by providing transmission means (not shown) either or both of an area between the output shaft 23 of the drive means 22 and the printing cylinder 21 or/and an area between the output shaft 43 of the independent drive means 42 and the in-feed roller 4 and the first computation unit S12 may be eliminated.

The speed signal D4 outputted from the compensation unit S14 undergoes frequency conversion in the drive control unit 44 and is outputted as the rotation signal D3, and the motor of the independent drive means 42 is rotationally controlled according to the rotation signal D3 and the peripheral speed of the in-feed roller 4 is increased and decreased.

An actual peripheral speed of the in-feed roller 4 with respect to the reference peripheral speed of the in-feed roller 4 shown here will be explained with reference to FIG. 3.

In FIG. 3, with the peripheral speed of the printing cylinder 21 entered in the horizontal axis and the peripheral speed of the in-feed roller 4 entered in the vertical axis, the reference peripheral speed of the in-feed roller 4 is represented by the characters, 6*f*, the peripheral speed of the in-feed roller 4 when the arm 56 of the dancer roller device 5 is in contact with the stopper 56*a* is represented by the characters, 6*a* and 6*b*, and the peripheral speed of the in-feed roller 4 when the arm 56 of the dancer roller device 5 is in contact with the stopper 56*c* is represented by the characters, 6*a*' and 6*b*'.

In this invention, as described above, the speed signal D4 is changed according to the displacement amount of the dancer roller 51, and therefore an area surrounded by the peripheral speeds 6*a* and 6*b* of the in-feed roller 4 when the arm 56 is in contact with the stopper 56*a* and the peripheral speeds 6*a*' and 6*b*' of the in-feed roller 4 when the arm 56 is in contact with the stopper 56*c*, which sandwiches the reference peripheral speed 6*f*, shows a peripheral speed difference area 6 being the range of the peripheral speed difference which can occur between the peripheral speed of the printing cylinder 21 and the peripheral speed of the in-feed roller 4.

In the peripheral speed difference area 6, the upper side is the area of the increased speed and the lower side is the area of the decreased speed with the reference peripheral speed 6*f* therebetween, and for example, from the point exceeding the printing cylinder peripheral speed g shown in the horizontal axis to 2*g*, the value, which is found by adding the value that is the reference peripheral speed 6*f* of the in-feed roller 4 in this range multiplied by a constant ratio (for example, 2 percent) as the maximum peripheral speed difference, is set as an upper limit peripheral speed 6*a* of the in-feed roller 4 in the high speed range, and the value, which is found by subtracting the value that is the same reference peripheral speed 6*f* multiplied by the aforementioned constant ratio as the maximum peripheral speed difference, is set as a lower limit peripheral speed 6*a*' of the in-feed roller 4 in the high speed range.

Similarly, from the printing cylinder peripheral speed g shown in the horizontal axis to 0, the value, which is found by adding the value of the reference peripheral speed of the in-feed roller 4 corresponding to an appropriate printing cylinder peripheral speed multiplied by a constant ratio (for example, 2 percent) as the maximum peripheral speed difference, is set as an upper limit peripheral speed 6*b* of the in-feed roller 4 in a low speed range, and the value, which is found by subtracting the value of the same reference peripheral speed multiplied by the aforementioned constant ratio as the maximum peripheral speed difference, is set as a lower limit peripheral speed 6*b*' of the in-feed roller 4 in the low speed range, irrespective of the printing cylinder peripheral speed.

Specifically, the upper limit peripheral speed 6*b* and the lower limit peripheral speed 6*b*' of the low speed range shown as an example in FIG. 3 are set by multiplying the reference peripheral speed 6*f* of the in-feed roller 4 at the printing cylinder peripheral speed g by the aforementioned constant ratio, and they are shown in parallel with the reference peripheral speed 6*f* with the peripheral speed of the in-feed roller 4 when the aforementioned arm 56 is in contact with the stopper 56*a* at the printing cylinder peripheral speed g and the peripheral speed of the in-feed roller 4 when the aforementioned arm 56 is in contact with the stopper 56*c* as the reference points.

As described above, the upper limit and the lower limit of the peripheral speed difference area 6 in the low speed range are not made proportional to the reference peripheral speed 6*f*, but are set at appropriate values, whereby the operation of the independent drive means 42 in the tension control in the low speed range can be finished quickly and smoothly.

Next, a situation in which the reference peripheral speed 6*f* of the in-feed roller 4 changes with the displacement of the dancer roller 51 at the printing cylinder peripheral speed of g' shown, for example between g and 2*g* on the horizontal axis will be explained.

At the reference peripheral speed 6*d* of the in-feed roller 4 at the printing cylinder peripheral speed g, the upper limit peripheral speed 6*c* of the high speed range and the lower limit peripheral speed 6*e* of the high speed range, when, for example, the dancer roller 51 moves from the tension position 51*a* to the reference position 51*b*, the value $h_n$ of the displacement signal D7 gradually decreases from $h_m$ to one half of $h_m$. Accordingly, the peripheral speed compensation signal D7' outputted by the second computation unit S13 gradually decreases, the speed signal D4 gradually decreases, and the peripheral speed of the in-feed roller 4 changes from the upper limit peripheral speed 6*c* of the high speed range to the reference peripheral speed 6*d*.

When the dancer roller 51 moves from the looseness side position 51*c* to the reference position 51*b*, the value $h_n$ of the displacement signal D7 gradually increases from 0 to one half of $h_m$. Accordingly, the peripheral speed compensation signal D7' outputted by the second computation unit S13 gradually increases, the speed signal D4 gradually increases, and the peripheral speed of the in-feed roller 4 changes from the lower limit peripheral speed 6*e* of the high speed range to the reference peripheral speed 6*d*.

Specifically, the dancer roller 51 is always controlled to be returned to the reference position 51*b*, whether the dancer roller 51 is at the tension side position 51*a* or at the looseness side position 51*c*.

As shown in, for example, FIG. 3, the operation speed of the rotary press is controlled so as to be proportional to the displacement amount of the dancer roller 51 with respect to the peripheral speed of the high speed range of the printing cylinder 21 in the peripheral speed difference area 6 sandwiched by the upper limit peripheral speed 6*a* and the lower limit peripheral speed 6*a*', in the high speed range in the area exceeding the printing cylinder peripheral speed g shown in the horizontal axis, and the operation speed of the rotary press is controlled to be substantially equally applied to the entire low speed range and proportional to the displacement amount of the dancer roller 51 in the peripheral speed difference area 6 sandwiched by the upper limit peripheral speed 6*b* and the lower limit peripheral speed 6*b*' in the low speed range of the area not higher than the printing cylinder peripheral speed g shown on the horizontal axis.

Thus, in the low speed range, as the peripheral speed of the printing cylinder 21 becomes lower, the ratio of the peripheral speed difference with respective to the reference peripheral speed 6*f* becomes larger, even when the displacement amount of the dancer roller 51 is the same. Accordingly, in the low speed range, when the displacement amount of the dancer roller 51 absorbing the tension variations caused by disturbances and the like is detected by the displacement detection means 52, the dancer roller 51 is quickly returned in the direction of the reference position 51*b*.

Specifically, the peripheral speed of the in-feed roller 4 with respect to the peripheral speed of the printing cylinder 21 is obtained from the following computing equations.

When the operation of the rotary press is in the range exceeding the predetermined operation speed g previously specified, specifically, $n_p > n_c$, the peripheral speed $n_i$ of the in-feed roller 4 is $$n_i = (d_p/d_i)n_p\{1+\eta(h_m/2-h_n)/h_m\}d_i\pi$$
$$= d_p\pi n_p\{1+\eta(h_m/2-h_n)/h_m\}$$

and when the operation of the rotary press is within the range not higher than the predetermined operation speed g previously specified, specifically, $n_p \leqq n_c$, the independent drive means 42 of the in-feed roller 4 is rotated so that the peripheral speed $n_i$ of the in-feed roller 4 is $$n_i = (d_p/d_i)\{n_p+\eta n_c(h_m/2-h_n)/h_m\}d_i\pi$$
$$= d_p\pi\{n_p+\eta n_c(h_m/2-h_n)/h_m\}:$$

where $n_i$ is the peripheral speed of the in-feed roller 4, $n_p$ is the peripheral speed of the printing cylinder 21, $n_c$ is the peripheral speed of the printing cylinder 21 according to the predetermined operation speed g previously specified, $h_m$ is the value of the displacement signal D7 when the dancer roller 51 is displaced to the looseness side position 51*c*, $h_n$ is the value of the displacement signal D7 at the displacement position of the dancer roller 51 at the point of time, $d_i$ is the diameter of the in-feed roller 4, $d_p$ is the diameter of the printing cylinder 21, $\eta$ is the ratio of the maximum peripheral speed difference to the peripheral speed of the printing cylinder 21 (constant ratio), and $n_i>0$, $n_p>0$, and $n_c>0$.

Incidentally, in one embodiment of this invention, the constant ratio to the peripheral speed of the printing cylinder 21 is 2 percent, that is, $\eta=0.02$, but this constant ratio can be suitably set.

According to each constitution described above, the dancer roller 51 is not displaced in such a manner as it often reciprocates between the tension side position 51*a* and the looseness side position 51*c*, and the dancer roller 51 is controlled to be always at the reference position 51*b*. Especially in the low speed range, while the dancer roller 51 is quickly displaced to keep the ability of absorbing tension variations high, the position control of the dancer roller 51 can be performed smoothly, and normal tension can be always kept, thus making it possible to eliminate the fear of misregistration occurring due to tension variations and improve quality maintenance of the printing paper surface. The upper limit and the lower limit of the peripheral speed difference area 6 in the low speed range are not made proportional to the reference peripheral speed 6*f*, and they can be set at appropriate values, and therefore the operation of the independent drive means 42 to absorb tension variations in the low speed range can be finished surely, quickly and smoothly.

As explained thus far, by using the controller of running tension of paper web for rotary press according to the present invention, the disadvantage the aforementioned prior art has is solved, and the effect as described below can be obtained.

The speed signal is outputted so that the peripheral speed difference is gradually increased or decreased according to the displacement amount of the dancer roller displacing to absorb tension variations of the paper web, the peripheral speed of the in-feed roller to the reference peripheral speed is controlled to adjust tension, and the dancer roller can be quickly and smoothly returned to the reference position, whereby the dancer roller is not displaced in such a manner as to reciprocate frequently, and stable tension can be maintained.

Further, when the dancer roller is outside the reference position and the operation speed of the rotary press is increased and decreased in the low speed range which is not higher than the operation speed previously specified, the peripheral speed difference area at the operation speed previously specified is applied evenly to the entire low speed range, and the peripheral speed difference is added to or subtracted from the reference peripheral speed of the in-feed roller, whereby the dancer roller can be more quickly and smoothly returned to the reference position, and stable and normal tension can always be maintained, thus making it possible to obtain a printing paper surface without misregister in the low speed range and improve printing quality maintenance.

What is claimed is:

1. A controller of the running tension of a paper web for a rotary press compiling a paper feed unit to which a paper roll is attachable and a printing unit provided with a printing cylinder rotationally drivable according to an operation speed command, the controller comprising:

an in-feed roller which is placed to form a running path of a paper web drawn out of the paper roll to the printing cylinder and is rotationally driven by an independent drive means;

a dancer roller device having a dancer roller, which is placed to from the running path of the paper web from an area after the in-feed roller to an area where the paper web reaches the printing cylinder and is provided to be displaceable to absorb variations of running tension of the paper web, and provided with displacement detection means for detecting a displacement amount of the dancer roller; and a tension control processing unit for controlling a rotational speed of said in-feed roller by controlling an operation of said independent drive means based on the displacement amount of the dancer roller detected in the displacement detection means and based on the operation speed command, so that a peripheral speed of the in-feed roller becomes the same as a peripheral speed of the printing cylinder when the dancer roller is at a reference position specified in a displacement range of said dancer roller, the peripheral speed of the in-feed roller becomes lower than the peripheral speed of the printing cylinder when the dancer roller is displaced to a position at which the running path of the paper web is made longer than at the reference position, and the peripheral speed of the in-feed roller becomes higher than the peripheral speed of the printing cylinder when the dancer roller is displaced to a position at which the running path of the paper web is made shorter than at the reference position, and by controlling the operation of said independent drive means so that as the displacement amount of the dancer roller from the reference position becomes larger, the difference of the peripheral speeds of the printing cylinder and the in-feed roller becomes larger, said tension control processing unit including a first computation unit for generating a compensation speed command to perform computation compensation of a rotational frequency of the in-feed roller based as a difference of a diameter of the in-feed roller and a diameter of the printing cylinder so that the peripheral speed of the in-feed roller rotating according to the operation speed command of the printing cylinder conforms to the peripheral speed of the printing cylinder rotated according to the operation speed command; a comparison unit for comparing a command speed of the operation speed command of the printing cylinder that is inputted and a predetermined speed that is previously specified, outputting a voltage signal corresponding to the command speed when the command speed of the operation speed command exceeds the predetermined speed, and outputting a voltage signal corresponding to the predetermined speed when the command speed of the operation speed command is not higher than the predetermined speed; a second computation unit for generating a peripheral speed compensation speed by computing a peripheral speed difference of the peripheral speed of the in-feed roller to the peripheral speed of the printing cylinder corresponding to the displacement position of the dancer roller from the voltage signal corresponding to the be command speed from the comparison unit or the voltage signal corresponding to the predetermined speed and a displacement signal outputted from the displacement detention means according to the displacement amount of the dancer roller; and a compensation unit for outputting a speed signal by adding the compensation speed command generated in the first computation unit and the peripheral speed compensation signal generated in the second computation unit, and said tension control processing unit controls the rotation of the in-feed roller based on a speed signal outputted from the compensation unit.

2. A controller of the running tension of a paper web for a rotary press comprising a paper feed unit to which a paper roll is attachable and a printing unit provided with a printing cylinder rotationally drivable according to an operation speed command, the controller comprising:

an in-feed roller which in placed to form a running path of a paper web drawn out of the paper roll to the printing cylinder and is rotationally driven by an independent drive means;

a dancer roller device having a dancer roller, which is placed to form the running path of the paper web from an area after the in-feed roller to an area where the paper web reaches the printing cylinder and is provided to be displaceable to absorb variations of running tension of the paper web, and provided with displacement detection means for detecting a displacement amount of the dancer roller; and a tension control processing unit for controlling a rotational speed of said in-feed roller by controlling an operation of said independent drive means based on the displacement amount of the dancer roller detected in the displacement detection means and based on the operation speed command, so that a peripheral speed of the in-feed roller becomes the same as a peripheral speed of the printing cylinder when the dancer roller is at a reference position specified in a displacement range of said dancer roller, the peripheral speed of the in-feed roller becomes lower than the peripheral speed of the printing cylinder when the dancer roller is displaced to a position at which the running path of the paper web is made longer than at the reference position, and the peripheral speed of the in-feed roller becomes higher than the peripheral speed of the printing cylinder when the dancer roller is displaced to a position at which the running path of the paper web is made shorter than at the reference position, and by controlling the operation of said independent drive means so that as the displacement amount of the dancer roller from the reference position becomes larger, the difference of the peripheral speeds of the printing cylinder and the in-feed roller becomes larger, said tension control processing unit controlling the operation of the independent drive means so that a maximum value of a difference of the peripheral speeds of the printing cylinder and the in-feed roller becomes a value obtained by multiplying the operation speed of the rotary press by a constant ratio when the operation of the rotary press is in a range exceeding the predetermined operation speed previously specified, and the maximum value of the difference of the peripheral speeds of the printing cylinder and the in-feed roller becomes larger than the value obtained by multiplying the operation speed of the rotary press by the constant ratio when the operation of the rotary press is in a range not higher than the predetermined operation speed previously specified.

3. The controller of running tension of paper web for rotary press according to claim 2, wherein the rotary press has a maximum operation speed and the predetermined operation speed of the rotary press previously specified is made to be one half of the maximum operation speed of the rotary press, and when the operation speed of the rotary press is in the range of not more than one half of the maximum operation speed of the rotary press, the maximum value of the difference of peripheral speeds of the printing cylinder and the in-feed roller is made the value obtained by multiplying one half of the maximum speed of the rotary press by the constant ratio to thereby control the operation of the independent drive means.

* * * * *